US009531077B1

(12) United States Patent
Weller et al.

(10) Patent No.: US 9,531,077 B1
(45) Date of Patent: Dec. 27, 2016

(54) FLEXIBLE ANTENNA AND METHOD OF MANUFACTURE

(71) Applicants: Thomas Weller, Lutz, FL (US); David Cure, Tampa, FL (US); Paul A. Herzig, St. Petersburg, FL (US); Felix Miranda, Olmsted Falls, OH (US)

(72) Inventors: Thomas Weller, Lutz, FL (US); David Cure, Tampa, FL (US); Paul A. Herzig, St. Petersburg, FL (US); Felix Miranda, Olmsted Falls, OH (US)

(73) Assignees: University of South Florida, Tampa, FL (US); Raytheon Company, Waltham, MA (US); The United States of America, as represented by the Administrator of the National Aeronautics and Space Administration, Washington, DC (US)

( * ) Notice: Subject to any disclaimer, the term of this patent is extended or adjusted under 35 U.S.C. 154(b) by 56 days.

(21) Appl. No.: 14/691,201

(22) Filed: Apr. 20, 2015

Related U.S. Application Data

(60) Provisional application No. 61/981,539, filed on Apr. 18, 2014.

(51) Int. Cl.

| | |
|---|---|
| ***H01Q 1/38*** | (2006.01) |
| ***H01Q 9/16*** | (2006.01) |
| ***H01Q 9/04*** | (2006.01) |

(52) U.S. Cl.
CPC ..... *H01Q 9/16* (2013.01); *H01Q 9/0407* (2013.01)

(58) Field of Classification Search
CPC ..... H01Q 15/0013; H01Q 9/24; H01Q 9/065
USPC ..... 343/793, 812, 909, 700 MS
See application file for complete search history.

(56) References Cited

U.S. PATENT DOCUMENTS

| | | | | |
|---|---|---|---|---|
| 6,822,622 | B2 | 11/2004 | Crawford et al. | |
| 7,420,524 | B2 | 9/2008 | Werner et al. | |
| 8,950,266 | B2 | 2/2015 | Dickey et al. | |
| 2007/0182639 | A1* | 8/2007 | Sievenpiper | H01Q 15/008 343/700 MS |
| 2007/0285324 | A1* | 12/2007 | Waterhouse | H01Q 1/273 343/718 |
| 2012/0062433 | A1* | 3/2012 | Balanis | H01Q 1/38 343/720 |

OTHER PUBLICATIONS

Anagnostou et al., a direct-write printed antenna on paper-based organic substrate for flexible displays and WLAN applications, IEEE J Display Technol 6 ( 2010), pp. 558-564.

(Continued)

*Primary Examiner* — Dieu H Duong
(74) *Attorney, Agent, or Firm* — Molly L. Sauter; Smith & Hopen, P.A.

(57) ABSTRACT

A flexible microwave antenna having a "fish-scale" ground plane is provided. The approach represents a significant advance in the combined thickness and flexibility that can be achieved, especially when using relatively thick substrates which are important for optimum antenna performance. An increase in gain was observed when bent in a positive radius of curvature and further reduction of back radiation.

20 Claims, 12 Drawing Sheets

(56) References Cited

OTHER PUBLICATIONS

Armani et al., Re-configurable fluid circuits by PDMS elastomer micromachining, Micro Electro Mechanical Systems, 1999. Mems '99. Twelfth IEEE International Conference on , vol., No., pp. 222-227, Jan. 17-21, 1999.
Boudaghi et al., A Frequency-Reconfigurable Monopole Antenna Using Switchable Slotted Ground Structure, Antennas and Wireless Propagation Letters, IEEE , vol. 11, No., pp. 655-658, 2012.
Chen et al., Bandwidth enhancement of LTE/WWAN printed mobile phone antenna using slotted ground structure, Prog. Electromagn. Res., 129: pp. 469-483.
Costa et al., TE Surface Wave Resonances on High-Impedance Surface Based Antennas: Analysis and Modeling, IEEE Trans. Antennas Propagat., vol. 59, No. 10, pp. 3588-3596, Oct. 2011.
Couty et al., Ultra-flexible micro-antennas on PDMS substrate for MRI applications, Symposium on Design, Test, Integration and Packaging of MEMS/MOEMS (DTIP), 2012, pp. 126-131, Apr. 2012.
Cure et al., Low Profile Tunable Dipole Antenna Using Barium Strontium Titanate Varactors, IEEE Transactions on Antennas and Propagation, vol. 62, No. 3, pp. 1185-1193, Mar. 2014.
Cure et al., Study of a Low Profile 2.4 GHz Planar Dipole Antenna Using a High Impedance Surface With 1-D Varactor Tuning, IEEE Transactions on Antennas and Propagation, vol. 61, No. 2, pp. 506-515, Feb. 2013.
Cure, Reconfigurable Low Profile Antennas Using Tunable High Impedance Surfaces Ph.D. Thesis, Dept. Elect. University of South Florida, Tampa, FL, Jan. 2013.
Hage-Ali et al., A Millimeter-Wave Microstrip Antenna Array on Ultra-Flexible Micromachined Polydimethylsiloxane (PDMS) Polymer, IEEE Antennas and Wireless Propagation Letters, vol. 8, 2009, pp. 1306-1309.
Hayes et al., Flexible Liquid Metal Alloy (EGaIn) Microstrip Patch Antenna, IEEE Transactions on Antennas and Propagation, vol. 60, No. 5, May 2012, pp. 2151-2156.
IEEE Standard Test Procedures for Antennas, IEEE Std 149™-1979, pp. 1-135.
Koulouridis et al., Polymer—Ceramic Composites for Microwave Applications: Fabrication and Performance Assessment, IEEE Transactions on Microwave Theory and Techniques, vol. 54, No. 12, Dec. 2006, pp. 4202-4208.
Lin et al., Development of a Flexible SU-8/PDMS-Based Antenna, IEEE Antennas and Wireless Propagation Letters, vol. 10, 2011, 1108-1111.
Morales, Magneto-Dielectric Polymer Nanocomposite Engineered Substrate for RF and Microwave Antennas, Ph.D. Thesis, Dept. Elect. University of South Florida, Tampa, FL, 2011.
Pathak et al., An analysis of the radiation from apertures in curved surfaces by the geometrical theory of diffraction, Proceedings of the IEEE , vol. 62, No. 11, pp. 1438-1447, Nov. 1974.
Peterson et al., Poly(dimethylsiloxane) thin films as biocompatible coatings for microfluidic devices: Cell culture and flow studies with glial cells Biomed, Mater. Res. A 2005, 72A, pp. 10-18.
Talaei et al., Hybrid microfluidic cartridge formed by irreversible bonding of SU-8 and PDMS for multi-layer flow applications, Procedia Chemistry 1, pp. 381-384, 2009.
Tiercelin et al., PolyDiMethylSiloxane membranes for millimeter-wave planar ultra flexible antennas, J. Micromech. Microeng., vol. 16, pp. 2389-2395, 2006.
Tronquo et al., Robust planar textile antenna for wireless body LANs operating in 2.45GHZ ISM band, Electronics Letter, vol. 42, No. 3, pp. 142-143, Feb. 2006.
Volkov et al., Thin copper film for plasma etching of quartz, Optical Memory and Neural Networks (Information Optics), 18(1): pp. 40-43, 2009.
Wong, Compact and Broadband Microstrip Antennas. New York: John Wiley & Sons, Inc., 2002, pp. 79-85.
Zhang et al., Research on the Characteristics of Flexible Antennas for General Applications, in Microw. and Millimeter Wave Technol. Int. Conf., Apr. 21-24, 2008, vol. 4, pp. 1814-1817.
Zhang et al., The fabrication of polymer microfluidic devices using a solid-to-solid interfacial polyaddition, Polymer 50 2009, pp. 5358-5361.

* cited by examiner

Table I

NORMALIZED FLEXURAL RIGIDITY FOR DIFFERENT SCENARIOS

| Polymer height | Case I One layer of copper | Case II Two layers of copper | Case III Multi-material stack |
|---|---|---|---|
| Rigidity (1.25 mm) | 1* | 1200 | 8300 |
| Rigidity (2.5 mm) | 4.3 | 8100 | 30000 |

* Less rigid case (normalized values)

FLEXIBLE ANTENNA AND METHOD OF MANUFACTURE

CROSS-REFERENCE TO RELATED APPLICATIONS

This application claims priority to U.S. Provisional Patent Application No. 61/981,539 filed on Apr. 18, 2014 which is hereby incorporated by reference into this disclosure.

BACKGROUND OF THE INVENTION

In recent years, interest in the development of low profile, flexible, tunable, microwave antennas for portable applications, such as wearable electronics, biomedical devices and health monitoring sensors, has increased. The characteristics of flexible antennas, such as their ability to conform to a surface and their light weight, make these types of antennas desirable for use in many personal portable devices.

Microwave antennas are commonly fabricated by assembling multiple layers of conducting and insulating materials. Generally, the backside of the antenna is a metal ground plane and the top side of the antenna is a metal radiating element. Sandwiched between the two metal layers is typically a non-conducting, insulating substrate material. Previous researchers have developed flexible antennas by reducing the thickness of the insulating substrate layer or by using only one metal layer. However, the antennas resulting from these fabrication techniques are narrowband and do not meet the wideband requirements of many modern applications.

In most cases, the performance of an antenna improves as the thickness of the insulating substrate material increases. This is particularly true for low profile antennas where the electrical performance (i.e., matching, gain, efficiency, bandwidth, etc.) improves as the antenna thickness increases. Alternatively, from a mechanical standpoint, flexibility of the antenna improves as the thickness of the antenna is reduced. The overall stiffness of the antenna increases with the cube of the substrate thickness and stress increases linearly with the thickness of the substrate, thereby limiting the amount of deflection that is possible before the antenna permanently deforms or breaks. As such, a conflict exists between improving the antenna performance by increasing the thickness of the substrate and improving the flexibility of the antenna by decreasing the thickness of the substrate.

Accordingly, what is needed in the art is a low profile wideband antenna that meets required performance standards while also exhibiting desired flexibility.

SUMMARY OF INVENTION

In the present invention, a flexible, low profile, dipole antenna backed with a frequency selective high impedance surface and an overlapping conductor ground plane is presented that meets the required performance standards while also exhibiting desired flexibility.

In a particular embodiment, a multilayer antenna assembly in accordance with the present invention includes, a first substrate comprising a planar antenna fabricated on a first surface of the first substrate and a first flexible dielectric substrate having a first surface bonded to a second surface of the first substrate. The antenna further includes a second substrate having a frequency selective high impedance surface fabricated on a first surface of the second substrate, wherein the first surface of the second substrate is bonded to a second surface of the first flexible dielectric substrate, and a second flexible dielectric substrate having a first surface bonded to a second surface of the second substrate. The antenna further includes, an overlapping conductor ground plane bonded to a second surface of the second flexible dielectric substrate, wherein the overlapping conductor ground plane includes a plurality of overlapping conductive plates.

In an additional embodiment, a multilayer flexible antenna assembly in accordance with the present invention may include a first substrate comprising a planar dipole radiating element and a microstrip-to-coplanar strip balun positioned on a first surface of the first substrate and a balun ground plane positioned on a second surface of the first substrate, the balun ground plane positioned opposite the balun. The flexible antenna may further include a first flexible dielectric substrate having a first surface bonded to a second surface of the first substrate and positioned opposite the planar dipole radiating element. Additionally, the flexible antenna may include a second substrate comprising a frequency selective high impedance surface formed on a first surface of the second substrate, wherein the first surface of the second substrate is bonded to a second surface of the first flexible dielectric substrate and positioned opposite the planar dipole radiating element, and a second flexible dielectric substrate having a first surface bonded to a second surface of the second substrate and positioned opposite the planar dipole radiating element. The flexible antenna may additionally include a ground plane for the planar dipole radiating element which includes an overlapping conductor ground plane bonded to a second surface of the second flexible dielectric substrate and positioned opposite the planar dipole radiating element, wherein the overlapping conductor ground plane includes a plurality of overlapping conductive plates.

In the present invention, the flexibility of a multilayer antenna structure is improved by using overlapping metal plates (fish-scale) which dramatically reduces the rigidity of the antenna, thereby providing a flexible antenna which incorporates a frequency selective high impedance surface and can be implemented in low profile antenna applications.

BRIEF DESCRIPTION OF THE DRAWINGS

For a fuller understanding of the invention, reference should be made to the following detailed description, taken in connection with the accompanying drawings, in which.

DETAILED DESCRIPTION OF THE INVENTION

In various embodiments, the present invention provides a flexible, low profile, dipole antenna backed with a frequency selective surface (FSS) and overlapping metallic plates on the ground plane to improve the flexibility of the structure.

Figure 1:
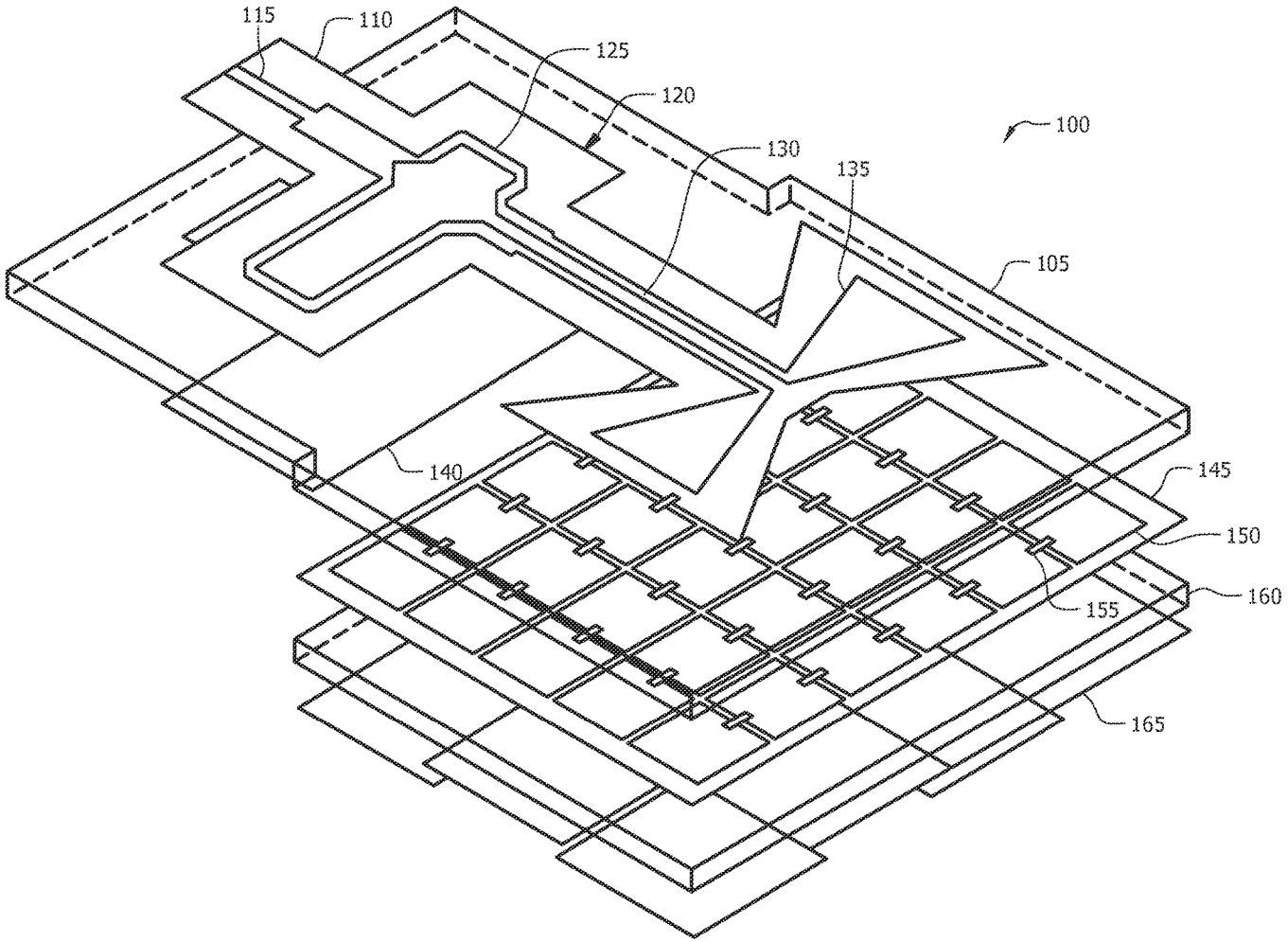
FIG. 1 is a diagrammatic view of a flexible, varactor diode based FSS (frequency selective surface), low profile antenna, in accordance with an embodiment of the present invention.

With reference to FIG. 1, the flexible antenna 100 of the present invention includes a first substrate 110 comprising a planar dipole antenna 120 fabricated on a first surface of the first substrate 105 and a balun ground plane 140 fabricated on a second surface of the first substrate 105. In one embodiment, the first substrate 110 is a liquid crystal polymer (LCP) copper-clad substrate. In one embodiment, the planar dipole antenna 120 may include a microstrip line 115, a microstrip-to-coplanar strip balun 125, a pair of coplanar strips 130 and a radiating dipole element 135. In this embodiment, the balun ground plane 140 is positioned below the microstrip line and the balun 125.

The flexible antenna 100 further includes a first flexible dielectric substrate 105 positioned below the first substrate 110, wherein the first flexible dielectric substrate 105 has a first surface bonded to the second surface of the first substrate 110. In a particular embodiment, the first flexible dielectric substrate 105 is a polydimethylsiloxane (PDMS) substrate.

The flexible antenna 100 further includes a second substrate comprising a tunable frequency selective (FSS) or a tunable high impedance surface (HIS) 145 positioned below the flexible dielectric substrate 105. The frequency selective high impedance surface 145 may include a periodic array of FSS elements 150 and variable reactance devices 155. The first surface of the frequency selective high impedance surface 145, comprising the FSS elements 150, is bonded to the second surface of the first flexible dielectric substrate 105 and the second surface of the frequency selective high impedance surface 145 is bonded to the first surface of a second flexible dielectric substrate 160. In a particular embodiment, the frequency selective high impedance surface 145 is fabricated on a liquid crystal polymer (LCP) substrate and the second flexible dielectric substrate 160 is a polydimethylsiloxane (PDMS) substrate.

The flexible antenna 100 further includes an overlapping conductor ground plane 165 bonded to a second surface of the second flexible dielectric substrate 160. In one embodiment, the overlapping conductor ground plane 165 includes a plurality of overlapping conductive plates. The overlapping conductive plates of the overlapping conductor ground plane 165 provide the desired flexibility in the ground plane for the planar dipole antenna 120, thereby providing a flexible multilayer antenna structure wherein the rigidity of the antenna is dramatically reduced.

In a particular embodiment, the antenna 100 is fed with a microstrip-to-coplanar strip balun 125 and uses two 2.4 mm-thick flexible dielectric substrate layers 105, 160, resulting in a total antenna thickness of ~λ/24 at the operational central frequency of 2.4 GHz.

With reference to FIG. 2A-2F, one of the biggest mechanical challenges to address in a multi-material stack structure is how to achieve flexibility. The stiffness of a composite beam is directly proportional to the cube of the thickness and the maximum deformation is experienced by those materials that are farthest from the neutral axis, "O". For an antenna, the need to achieve efficient and uni-directional radiation compels the use of a ground plane far from the bending neutral axis which increases the rigidity of the multi-material stack.

Figure 2A:
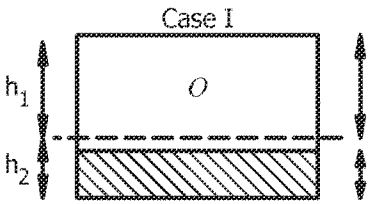
FIG. 2A is an illustration of a rectangular cross-section of a polydimethylsiloxane (PDMS) based substrate with one metal layer.
Figure 2B:
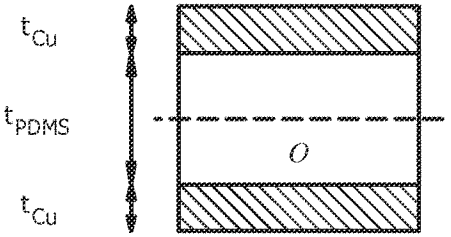
FIG. 2B is an illustration of a rectangular cross-section of a PDMS based substrate sandwiched between two metal layers.
Figure 2C:
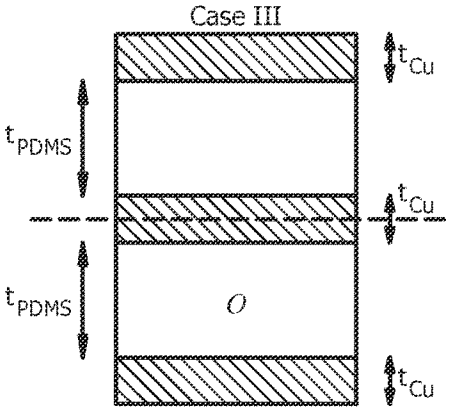
FIG. 2C is an illustration of a rectangular cross-section multi-material stack structure.
Figure 2D:
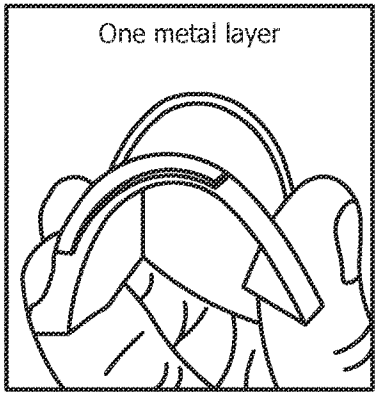
FIG. 2D is an illustration the device of FIG. 1A when bent to form a negative curvature.
Figure 2E:
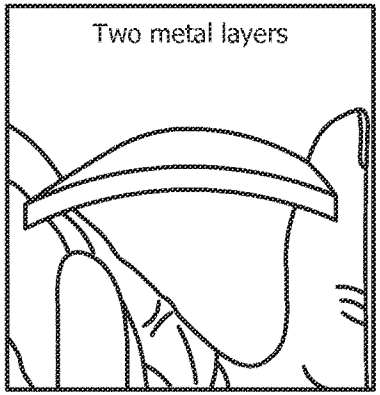
FIG. 2E is an illustration of the device of FIG. 2B when bent to form a negative curvature.
Figure 2F:
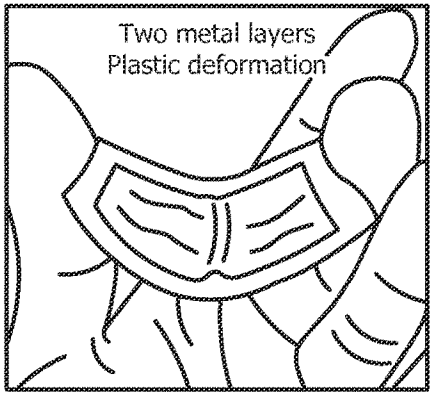
FIG. 2F is an illustration of the device of FIG. 2C, illustrating the plastic deformation of the metal layer that results when the device is bent.

Three different scenarios are depicted with reference to FIG. 2A-2F, including a polymer using only one copper layer (Case I), as shown in FIG. 2A and FIG. 2D, two copper layers (Case II) as shown in FIG. 2B and FIG. 2E and a multi-material stack (Case III), as shown in FIG. 2C and FIG. 2F. The normalized rigidity was calculated for each of Cases I-III and is shown with reference to Table I of FIG. 3.

Figures 3, 4:
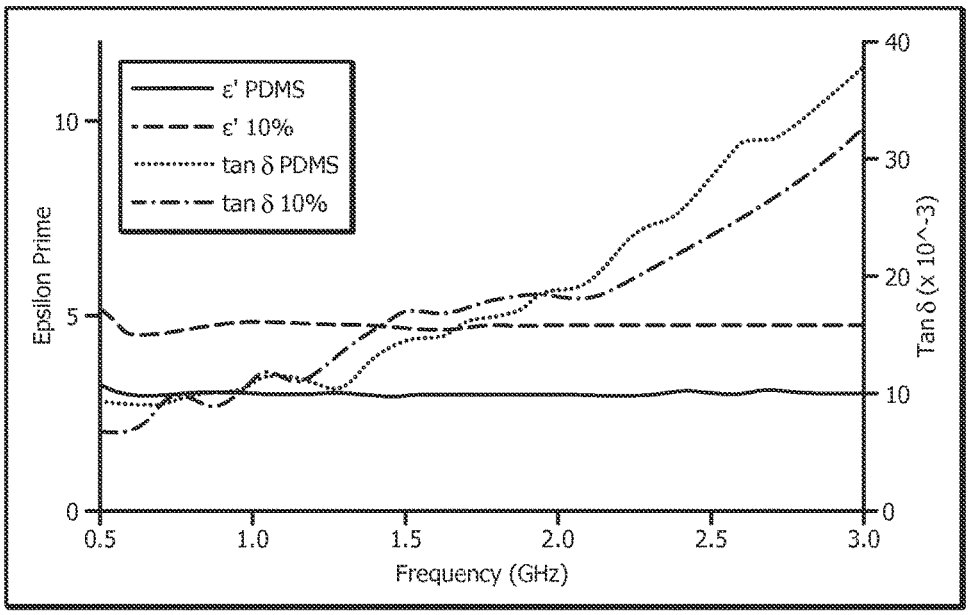
FIG. 3 is a table representing the normalized flexural rigidity for different scenarios in accordance with various embodiments of the present invention.
FIG. 4 is graph representing the dielectric constant and loss tangent for the PDMS-ceramic samples at different volume ratios in accordance with various embodiments of the present invention.

With reference to FIG. 2A and FIG. 2D and Table I of FIG. 3, for Case I, the normalized rigidity of a substrate board with polymer thickness ($t_{PDMS}$) of 1.25 mm and one copper layer of thickness ($t_{Cu}$) of 0.25 μm is equal to 1. If the polymer thickness doubles, then rigidity increases by a factor of 4.3. In this case, the neutral axis does not pass through the centroid of the composite substrate material, but instead lies closer to the copper layer, thereby reducing the deformation of the copper layer. However, when a flexible material is sandwiched between two metal layers (Case II), FIG. 2B and FIG. 2E, the rigidity is increased by over three orders of magnitude in the examples in Table I. The metal layers will experience more plastic deformation than the polymer because the metal layers have a higher modulus of elasticity and are farther from the neutral axis (FIG. 2F). For a multi-material stack structure (Case III), FIG. 2C and FIG. 2E, the rigidity of the board is increased by factor of 8,300 and 30,000 with respect to Case I when the thickness of the PDMS is 1.27 mm and 2.5 mm, respectively.

Another challenge of antenna design is reducing the losses caused by the series resistance of the barium strontium titanate (BST) varactors making up the tunable devices in the frequency selective high impedance surface 145, while using a relatively thin substrate. Full wave analysis of the unit cells using Ansoft HFSS predicts that the series resistance of a varactor has less negative impact on the antenna performance as the substrate thickness is increased. However, increasing the substrate thickness also increases the rigidity, as previously described.

A reconfigurable frequency selective surface (FSS) or tunable high impedance surface (HIS) 145 can include tunable elements. For example, resonant circuits can be used to provide interconnections that are equivalent to open switches at one frequency, and equivalent to closed switches at another frequency. For example, a first pattern of interconnected conducting patches can be obtained at a first frequency, and a second pattern of interconnected conducting patches can be obtained at a second frequency. The frequency-dependent properties of a resonance frequency can be modified using a tunable capacitor and/or tunable inductor. Hence, the pattern of effective electrical interconnections at a given frequency can be modified by changing the resonance frequency of resonant circuits. A transistor or other device (such as a digital or analog integrated circuit) can also be used to control an electric signal provided to one or more tunable elements, for example a tunable capacitor, so as to adjust the characteristics of the tunable element.

A variety of tunable elements or combinations of tunable elements can be used in a reconfigurable FSS, HIS, or artificial magnetic conductor (AMC) 145 and/or also within a reconfigurable antenna. These include tunable capacitors and/or inductors, variable resistors, or some combination of tunable elements. A control electrical signal sent to a tunable element within an AMC backplane or portion thereof can be correlated with an electrical signal sent to a radiative element of an antenna (for example, a frequency tuning element). Approaches to tunable capacitors include MEMS devices, tunable dielectrics (such as ferroelectrics or BST materials), electronic varactors (such as varactor diodes), mechanically adjustable systems (for example, adjustable plates, thermal or other radiation induced distortion), other electrically controlled circuits, and other approaches known in the art. Resistive elements can also be switched in and out of a reconfigurable conducting pattern or associated tuned circuit (such as described above) so as to provide controllable bandwidth, loss, or other electrical parameter.

In a particular embodiment, the flexible material selected for the first flexible dielectric substrate 105 and the second flexible dielectric substrate 160 of the antenna assembly 100 is polydimethylsiloxane (PDMS) mixed with ceramic loading to achieve miniaturization. In a specific embodiment, the PDMS type selected is Sylgard 184 from Dow Corning which has been widely used for microwave applications. The ceramic powder used for loading the PDMS is the ultra-low fire UFL990 from Ferro Corp, which is a high dielectric constant (~90), small particle size (0.4 μm) and low loss material. Prior to implementing the multi-layer antenna design, the high frequency electrical properties of the materials were determined using Agilent's 85070D dielectric probe kit.

Figure 5:
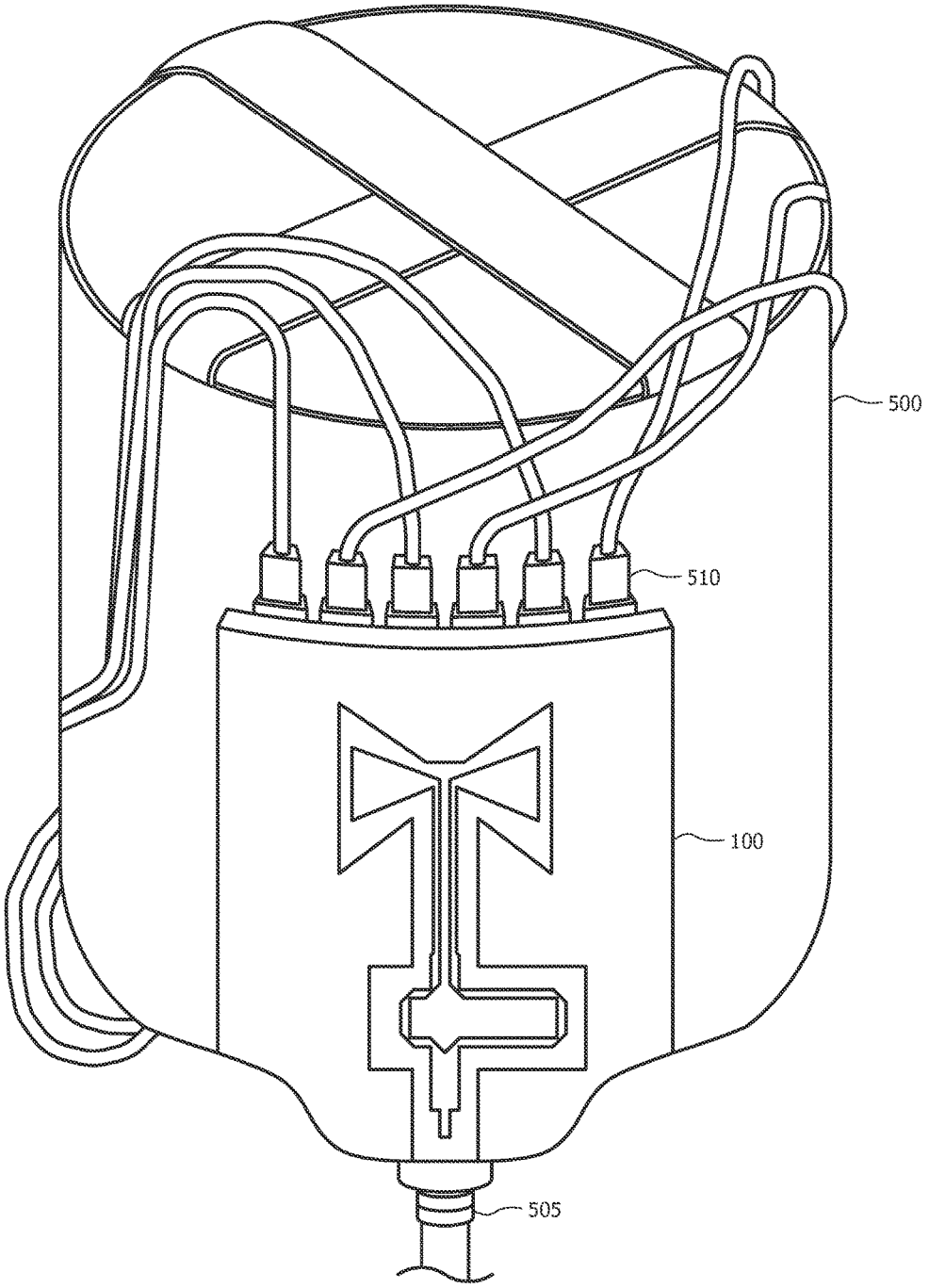
FIG. 5 is a diagrammatic illustration of a flexible bowtie antenna of the present invention conformed to a foam cylinder for an experimental test setup.

FIG. 4 illustrates the dielectric constant and electric loss tangent for different volume ratios in a frequency range from 500 MHz to 3 GHz. The frequency of operation of the dipole antenna 100 was chosen to be around ~2.4 GHz to be consistent with previous works and to facilitate in-house fabrication, illustrated in FIG. 5. As shown in FIG. 5, the flexible antenna 100 was secured to a styrofoam cylinder of 50 mm radius r to perform the bending tests for the antenna 100. The cylinder 500 was used to create a negative curvature in the flexible antenna 100. In this in-house fabrication, the flexible antenna 100 is fed by a coaxial probe 505 and a plurality of connections 510 were made to the antenna 100 to measure the magnitude of the reflection coefficient of the antenna 100. In fabrication of the antenna 100, the dipole was printed on liquid crystal polymer (LCP). The LCP type used was ULTRALAM 3850 which has a low dielectric constant and low dielectric loss ($\in r$=2.9 and tan $\delta$=0.0025). The LCP layer thickness was 25 μm with double-side copper cladding of 9 μm on which the radiating element 135 and the partial ground plane 140 were patterned using photolithography. The PDMS has an average thickness of 2.5 mm. The LCP and (blended) PDMS were bonded together using SU8-5 photoresist as an intermediate layer. The SU8-5 was spun onto the LCP at 2000 rpm (~7 μm thickness), then exposed and developed following the manufacturer specifications. The SU8-5 was then treated with APTES as is known in the art. Separately, the PDMS substrate was exposed to oxygen plasma at 10 W, 50 standard cubic centimeters per minute (sccm) for 30 seconds. The LCP and PDMS were aligned with respect to each other and pressed together in a vacuum oven at 70° C. for 3 minutes to create a permanent bond between the two materials.

The FSS 145 and antenna substrate 110 were then cured at ambient temperature over a leveled optical table to maintain a uniform height and to avoid an increment on the Young's modulus of the material. The maximum variation allowed for the substrate height is ~±0.1 mm to minimize possible changes in the frequency response.

Figure 6:
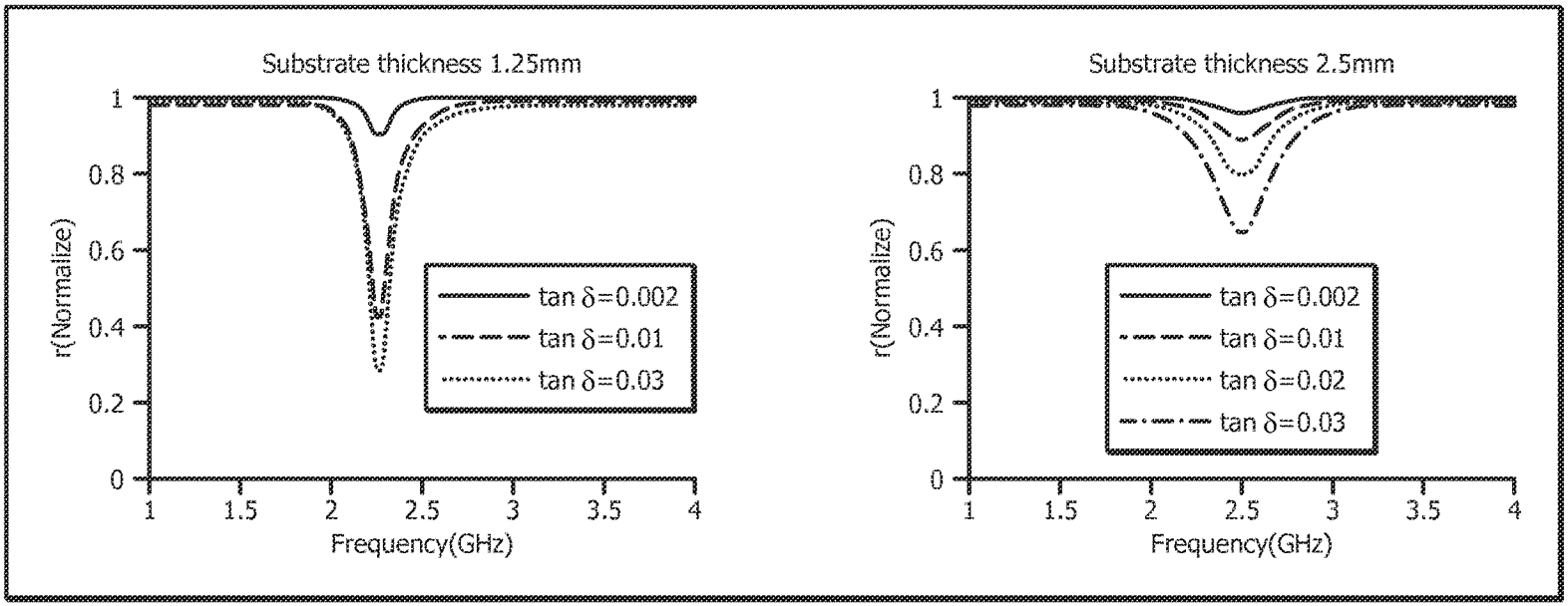
FIG. 6 is a graphical illustration of the impact of the substrate losses and thickness on the reflection coefficient magnitude of the tunable FSS, in accordance with an embodiment of the present invention.
Figure 7:
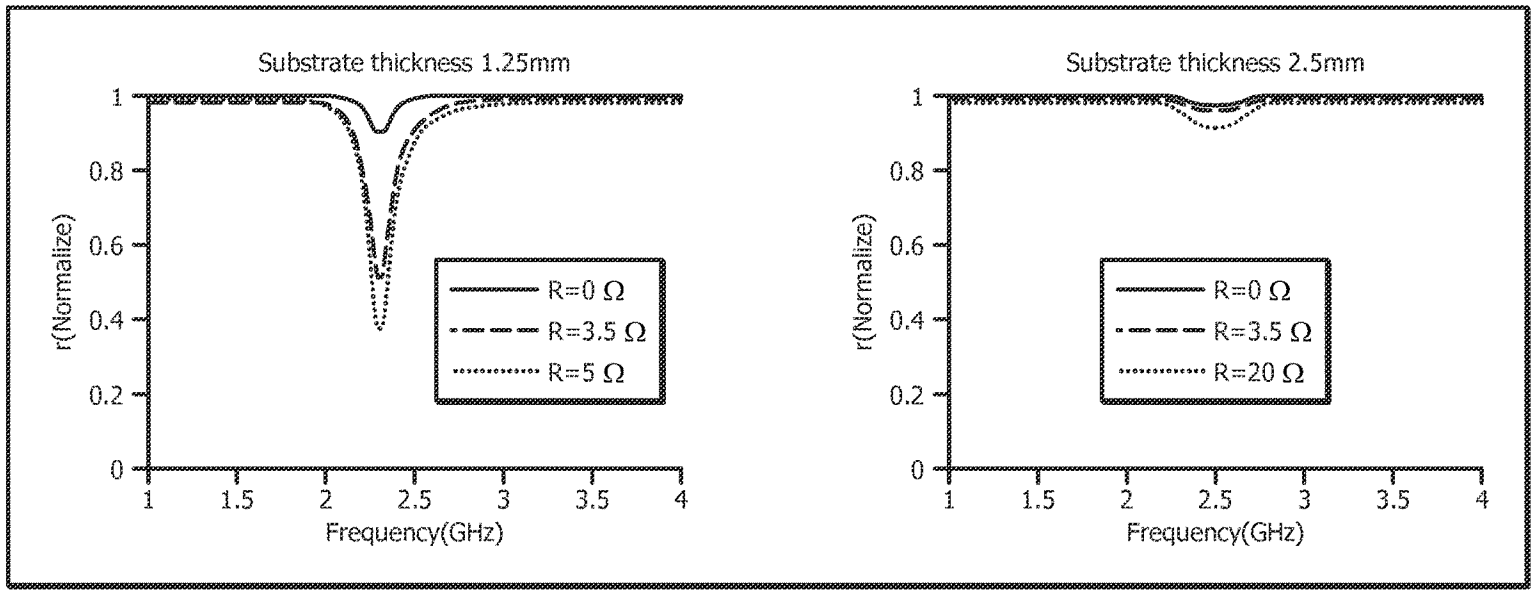
FIG. 7 is a graphical illustration of the impact of the substrate thickness and varactor losses on the reflection coefficient magnitude of the tunable FSS, in accordance with an embodiment of the present invention.

Simulations of the magnitude of the reflection coefficient ($\Gamma$) of a unit cell using different substrate losses and two different substrate heights are depicted in FIG. 6. The results show that the magnitude of reflection coefficient ($\Gamma$) reduces with increasing substrate loss tangent and ($\Gamma$) is particularly degraded when the FSS substrate is thinner. Also, as it was previously discussed, increasing the substrate thickness increases the rigidity. FIG. 7 shows the effect of the equivalent series resistance of the varactor on the magnitude of the reflection coefficient for different substrate thicknesses.

Figure 8:
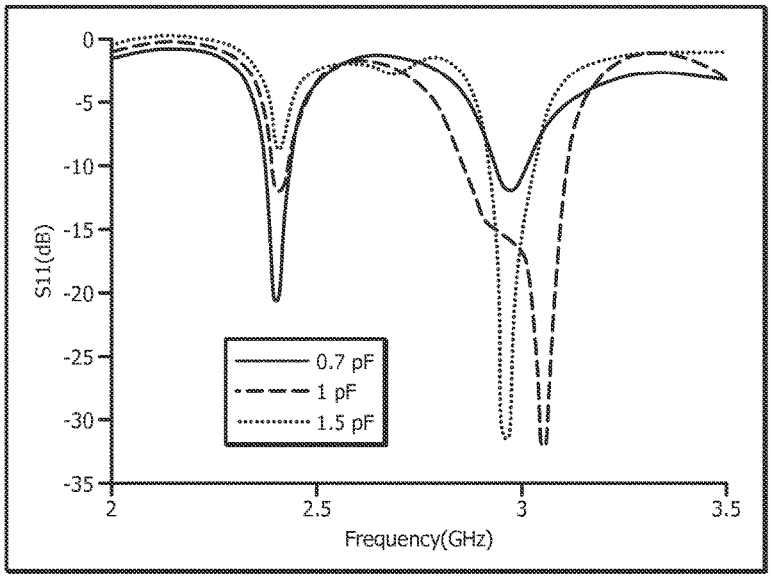
FIG. 8 is a graphical illustration of the measured and simulated S11 for different capacitance values (0.7 pF, 1 pF and 1.5 pF), in accordance with an embodiment of the present invention.

To validate the impact on the antenna gain due to variations on the FSS height, three FSS's with different substrate heights were fabricated with SMD chip capacitors (equivalent series resistance, ESR=~0.5Ω). In these embodiments, all three FSS's consisted of 30 unit cells and 25 chip capacitors and they were designed to operate at ~2.4 GHz, but built with substrates thicknesses of 2.0 mm, 2.3 mm and 2.5 mm and capacitance values of 1.2 pF, 0.7 pF and 0.5 pF, respectively. $S_{11}$ of the antenna backed with the three capacitive loaded FSS's are shown in FIG. 8. The antenna backed with the 2.5 mm height FSS had the highest gain (0.8 dB) and better impedance matching than the others. The gain of the 2.3 mm and 2.0 mm designs was 0.6 dB and 3.5 dB lower, respectively, with respect to the 2.5 mm height. These results are in agreement with the unit cells simulations in FIG. 7.

Figure 9:
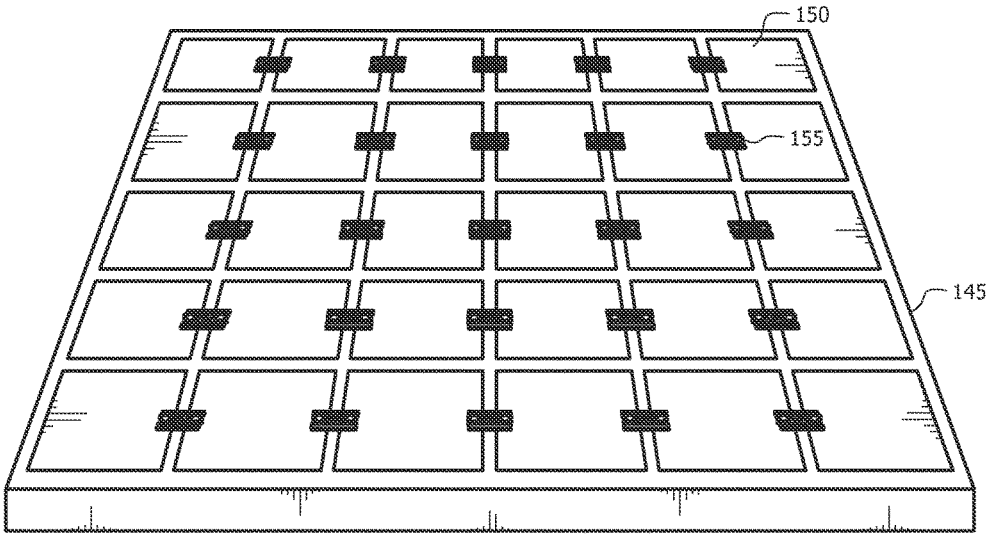
FIG. 9 is an illustration of a capacitive loaded FSS, in accordance with an embodiment of the present invention.

The capacitive loaded frequency selective high impedance surface 145 fabricated on the second substrate is shown with reference to FIG. 9. As illustrated, the FSS 145 comprises a periodic array of voltage controlled varactor elements, each comprising a conductive patch element 150 loaded by a varactor diode 155. In an additional embodiment, the frequency selective high impedance surface 145 comprises a plurality of interdigital barium strontium titanate (BST) varactor-tuned unit cells.

Figure 10:
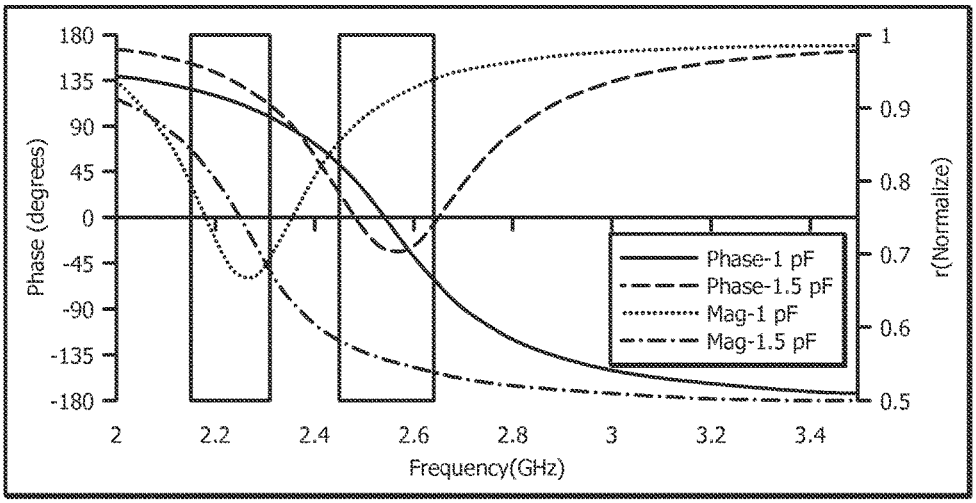
FIG. 10 is a graph illustrating the simulated reflection coefficient phase and magnitude of the flexible tunable FSS, in accordance with an embodiment of the present invention.

To design the tunable FSS, simulations of the phase and the magnitude of the reflection coefficient (F) of a unit cell were performed. The capacitance was varied from 1 pF to 1.5 pF to correspond with the approximate measured tunable range of the BST varactors and the FSS thickness of ~2.4 mm was assumed. The results shown in FIG. 10 predict a tunable bandwidth of 400 MHz, from 2.2 GHz to 2.6 GHz, when the criterion of 0±45° phase shift is used. These results take into account an extracted varactor series resistance of 3.5 ohms and a substrate loss tangent of 0.02.

Figure 12:
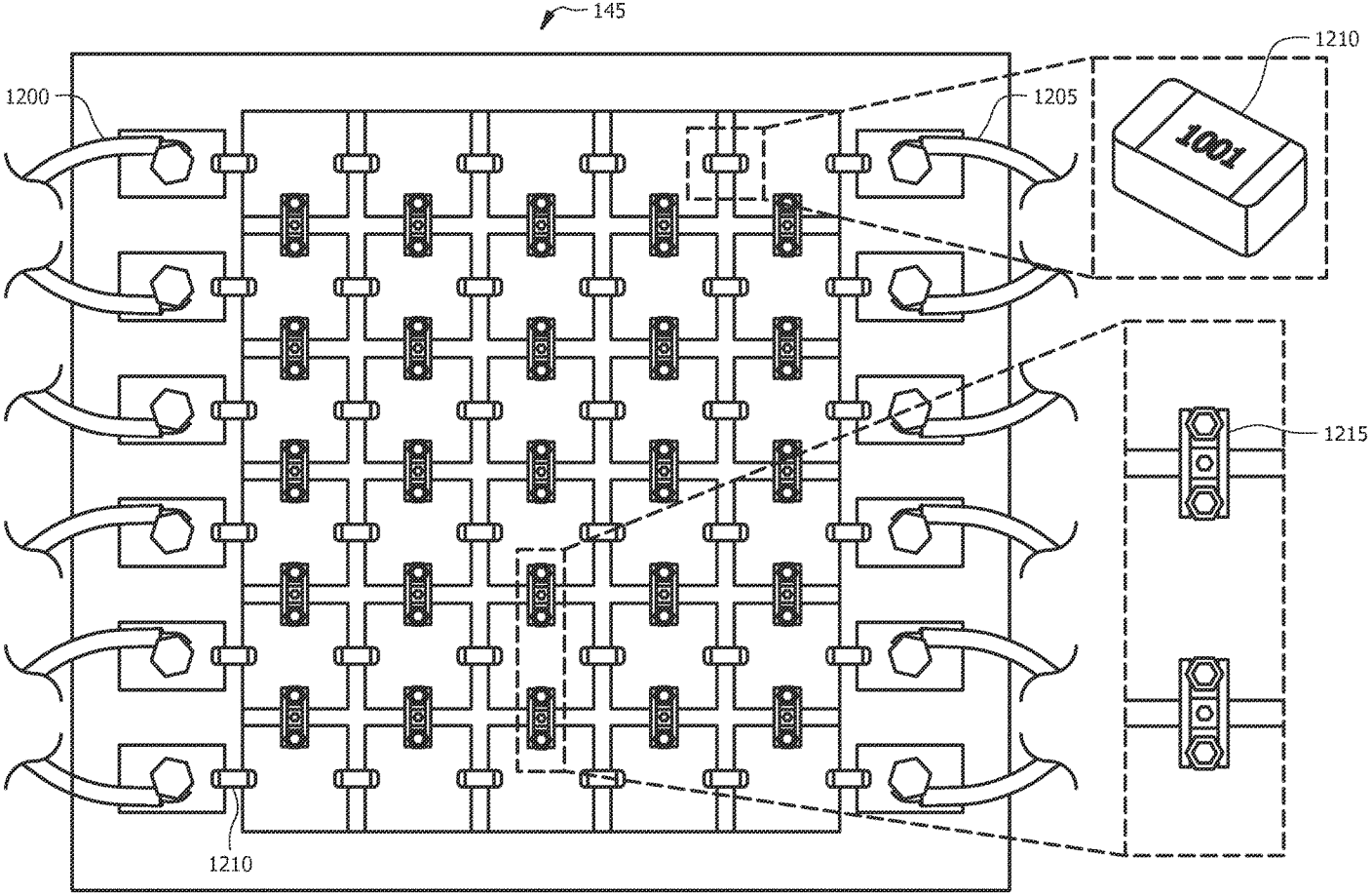
FIG. 12 is an illustration of a tunable FSS having a bias network, in accordance with an embodiment of the present invention.

As shown with reference to FIG. 12, in a particular embodiment, the tunable FSS layer 145 was fabricated using a ~2.4 mm-thick 10% volume blended PDMS ceramic flexible dielectric substrate 160, with a relative dielectric constant of ~5. In this embodiment, the FSS 145 has a planar size of 64×65 $mm^2$, including the bias network 1200, 1205. This bias 1200, 1205 network is distributed in 5 columns, each containing seven BST chips in series 1215, and 6 rows with 1 KΩ resistors 1210 in series. The varactors 1215 were placed in the direction parallel to the main axis of the bowtie dipole antenna 135 to achieve higher tunability. A 1 kΩ resistor 1210 was used at the ends of each row to block RF leakage onto the bias lines 1200, 1205. When a voltage is applied to the bias lines 1200, 1205 the effective capacitance of the varactors 1215 changes, adjusting the sheet capacitance and tuning the resonance frequency of the FSS 145. For a low input voltage at the bias lines 1200, 1205 the capacitance is high, and for a high input voltage the at the bias lines 1200, 1205 the capacitance is low.

Figure 11:
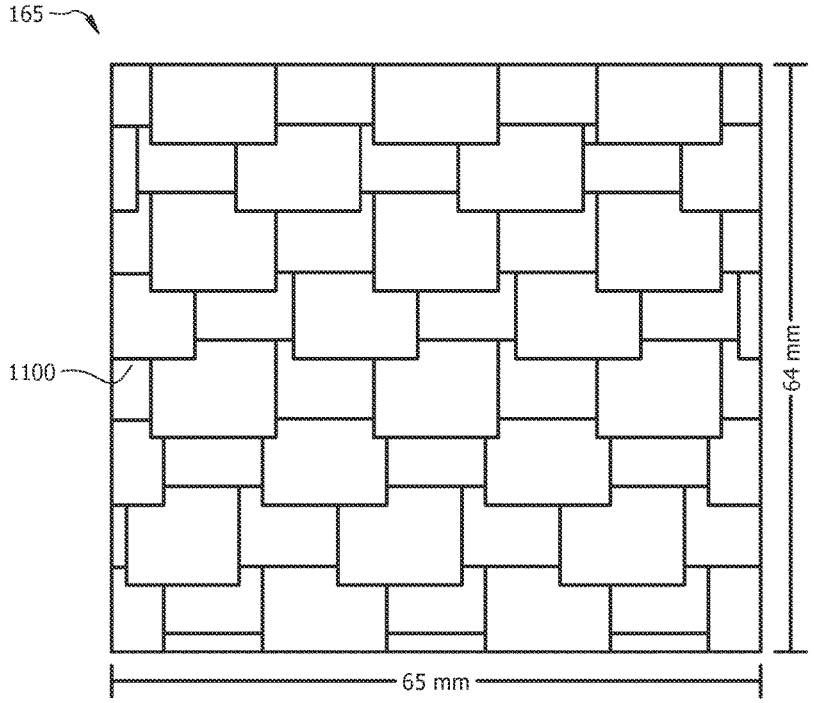
FIG. 11 is an illustration of an overlapping ground plane having overlapping metallic layers, in accordance with an embodiment of the present invention.

The FSS's 145 ground plane 165 has overlapping metallic plates instead of a continuous metal layer to improve flexibility. FIG. 11 illustrates the "fish scale" ground plane of the FSS 145. The FSS 145 ground plane comprises overlapping metallic plates 1100 instead of a continuous metal layer to improve flexibility. In a particular embodiment, dimensions of the metal plates forming the ground plane are approximately 21×13 $mm^2$.

In a specific embodiment, the metal plates 1100 are fabricated by keeping the copper on one side of the LCP and patterning the other side using photolithography. In this embodiment, the copper is partially removed on the side to be bonded to the flexible dielectric substrate 165, to overlap the plates and have an electrical connection, and bonded to the PDMS (polydimethylsiloxane). The overlapping distance among metal plates is approximately between 1-2 mm. Following the copper removal, SU-8 photoresist was spun onto the LCP and patterned into a square grid to increase the flexibility of the metal plates. In this embodiment, the LCP was prepared for bonding using APTES (3-Aminopropyl) triethoxysilane and the squares were cut with a precision scalpel. The LCP squares and PDMS were aligned with respect to each other and pressed together in a vacuum oven at 70° C. for 3 minutes to create a permanent bond between the two materials.

Figure 13:
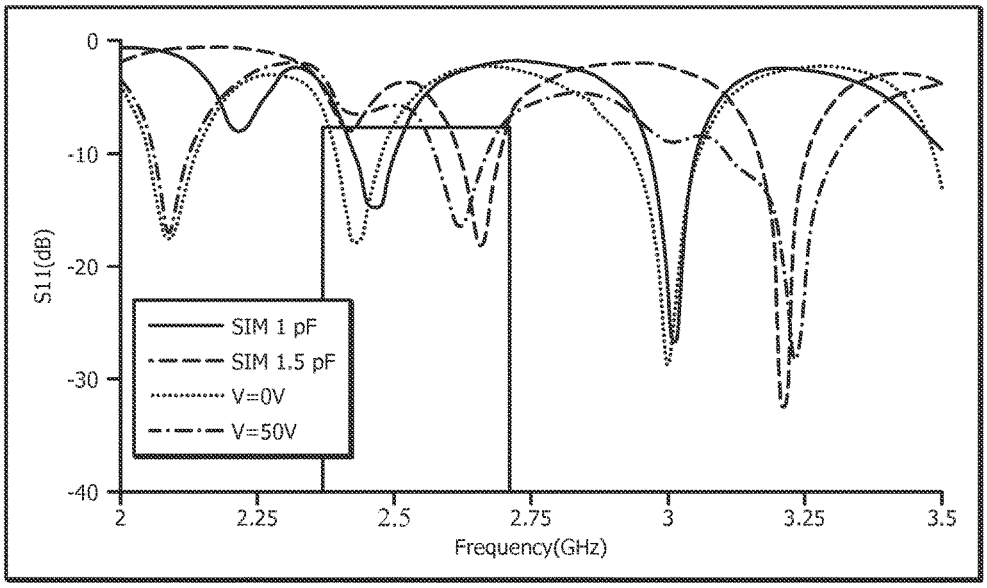
FIG. 13 is a graph illustrating measured and simulated S11 when 0 V and ±50 V is applied to all bias ports, in accordance with an embodiment of the present invention.

Measured $S_{11}$ data for the antenna when applying a common bias voltage of 0 and ±50 V to the DC bias ports are shown in FIG. 13. Using the 10 dB return loss criterion, there is a 280 MHz span between the low end of the response with 0 V and the high end of the response using 50 V (grey shadowed region in FIG. 13). Two additional resonances appear at 2.0 GHz and 3 GHz when the input bias is 0 V and they these are shifted up ~200 M Hz when the voltage is 50V as consequence of TE surface wave propagation. The resonant frequencies of these modes can be calculated using the cavity model analysis as is known in the art. This analysis predicts a TE resonance at ~2.07 GHz and 3.1 GHz for a FSS structure composed of five unit cells with periodicity of 9.9 mm.

Figure 14A:
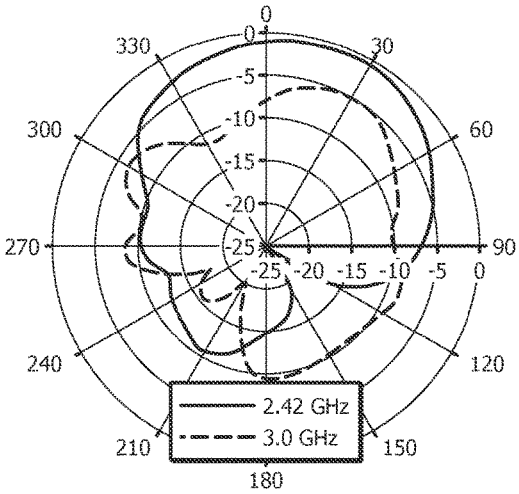
FIG. 14A is a graphical illustration of measured E-plane radiation patterns for the antenna with bias voltage of 0 V at different frequencies in accordance with an embodiment of the present invention.
Figure 14B:
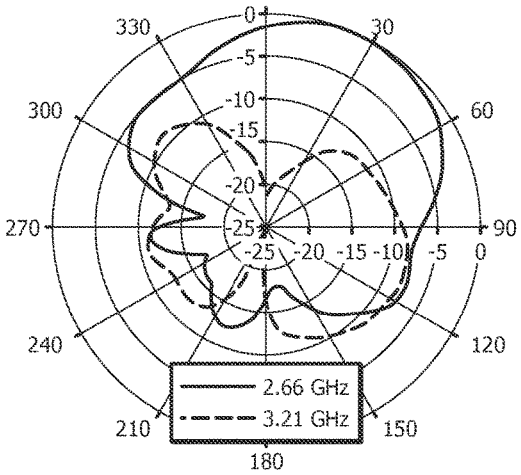
FIG. 14B is a graphical illustration of measured E-plane radiation patterns for the antenna with bias voltage of ±50 V at different frequencies in accordance with an embodiment of the present invention.
Figure 15:
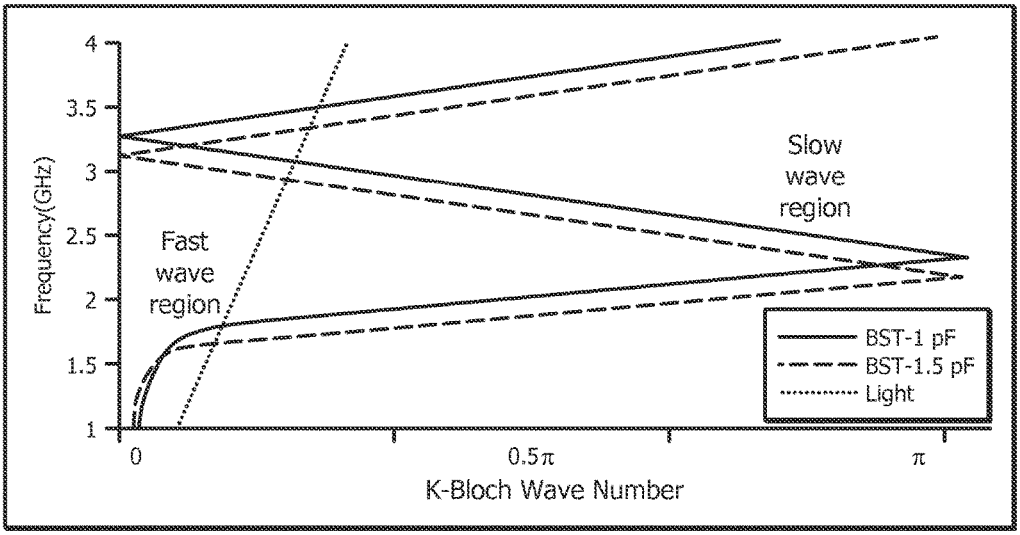
FIG. 15 is a graphical illustration of a dispersion diagram obtained by cascading 6 unit cells with periodicity of 9.9 mm for C=1 pF and C=1.5 pF in accordance with an embodiment of the present invention.

The E-plane radiation patterns of the antenna for different bias voltages are shown in FIG. 14. The radiation patterns of the antenna with bias voltage of 0 V and ±50 V demonstrate cancellation of back radiation at 2.42 GHz and 2.66 GHz, which is within to the operational frequency of the tunable antenna shown in FIG. 10. The patterns are rotated ~25° due to the presence of surface waves. The effects of surface waves are observed in the radiation pattern due to the absence of vias in the high impedance surface (HIS). FIG. 14 also depicts the patterns at 3.0 GHz and 3.21 GHz which suggest the presence of leaky waves. The dispersion diagram of the 6 cascaded unit cells for different capacitance values was simulated using one dimensional (1D) simulation in HFSS. The Bloch dispersion diagram was calculated using the scattering parameters taking into account the number of cells along the direction of the electric field of the dipole (linearly polarized) which is where major excitation of surface waves is produced. The dispersion diagram shows backward/forward leaky waves at ~2.8 GHz for a capacitance value of 1.5 pF and at ~3 GHz for 1 pF. The leaky waves are supported in the fast wave region indicated to the left side of the light line shown in FIG. 15.

The gains of the antenna 100 backed with an FSS 145 using a continuous and a fish scale ground plane 165 were compared to each other. The continuous ground plane case was obtained by covering the fish scales with adhesive copper tape. The measured gain for the fish scale case was −0.86 dBi at 2.4 GHz for a 0V input bias and for the continuous case the gain was 0.4 dBi. This represents a ~1.3 dB gain reduction when using the fish-scale metal layer instead of a continuous ground. The low gain in both cases may be attributed to the material losses and variations on the FSS height. The simulated antenna gain at broadside obtained with Ansoft HFSS using a continuous ground plane is approximately 1.6 dBi at 2.4 GHz; however the 0.04 loss tangent of the SU8-5 bond layer and possible variations of the substrate height were not included in the model to reduce the computational requirements.

Figure 16:
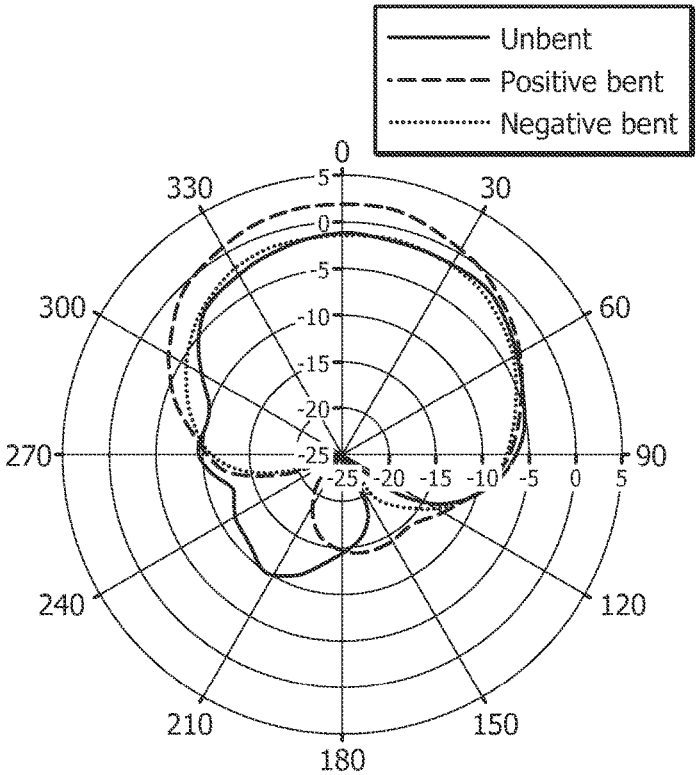
FIG. 16 is an illustration of measured E-plane radiation patterns for the antenna bent with negative curvature and positive curvature, in accordance with an embodiment of the present invention.
Figure 17:
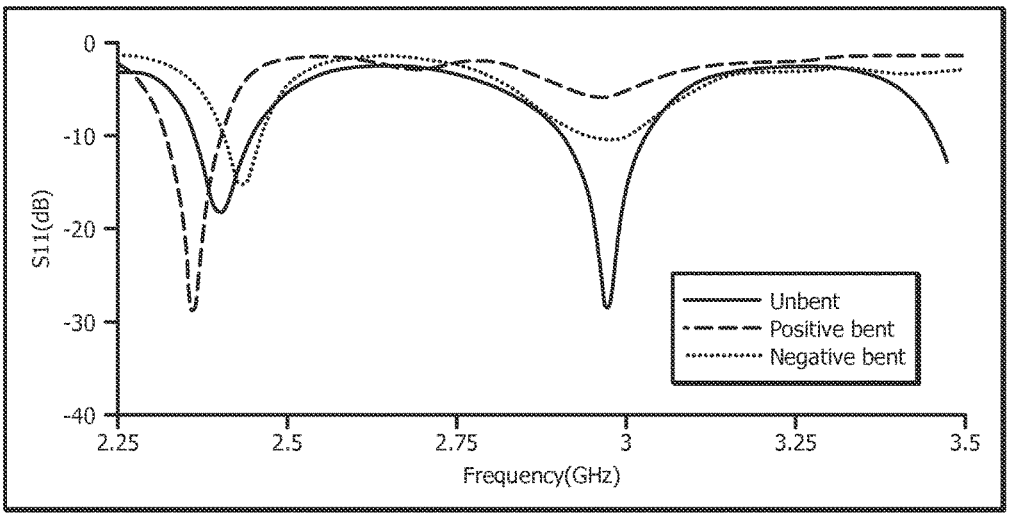
FIG. 17 is a graphical illustration of a measured S 11 of the bowtie dipole antenna backed with an FSS unbent, bent with positive curvature and negative curvature, in accordance with an embodiment of the present invention.

As previously described, a styrofoam cylinder of 50 mm radius r was used to perform the bending tests for the antenna 100. The angle of curvature θ was determined using the formula which defines the central angle whose vertex is the center of a circle (L=64 mm). FIG. 16 and FIG. 17 show the radiation pattern and $S_{11}$ data when the antenna is unbent and bent (positive and negative) with an applied bias voltage of 0V and a negative curvature and positive curvature of θ=77°. The results show that when the antenna 100 is bent in positive curvature the frequency shifts up 40 MHz (1.6%) and the gain at 2.36 GHz increases by 3.1 dB for an angle of 77° for V=0 V with respect the unbent case. This gain increase is realized because there is less back radiation as the angle increases and the ground plane curves toward the dipole direction. For the negative bending case the frequency shifts up 20 MHz (0.86%) and the gain maintains similar values as the unbent antenna (~−0.7 dB), but there is less back radiation as consequence of the curvature of the ground plane.

It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An antenna assembly comprising:

a first flexible substrate comprising a planar antenna fabricated on a first surface of the first flexible substrate;

a first flexible dielectric substrate having a first surface bonded to a second surface of the first flexible substrate;

a second flexible substrate comprising a frequency selective high impedance surface fabricated on a first surface of the second flexible substrate, the first surface of the second flexible substrate bonded to a second surface of the first flexible dielectric substrate;

a second flexible dielectric substrate having a first surface bonded to a second surface of the second flexible substrate; and an overlapping conductor ground plane comprising a plurality of overlapping conductive plates and each of the plurality of overlapping conductive plates comprising a first portion bonded to the second surface of the second flexible dielectric substrate and a second portion not bonded to the second surface of the second flexible dielectric substrate, wherein the second portion of each of the plurality of overlapping conductive plates is positioned to overlap another of the plurality of conductive plates having a first portion bonded to the second surface of the second flexible dielectric substrate to form the overlapping conductor ground plane.

2. The antenna assembly of claim 1, wherein the first flexible substrate is a copper-clad liquid crystal polymer (LCP) substrate.

3. The antenna assembly of claim 1, wherein the first flexible dielectric substrate comprise polydimethylsiloxane (PDMS).

4. The antenna assembly of claim 1, wherein the second flexible substrate is a copper-clad liquid crystal polymer (LCP) substrate.

5. The antenna assembly of claim 1, wherein the second flexible dielectric substrate comprise polydimethylsiloxane (PDMS).

6. The antenna assembly of claim 1, wherein the planar antenna is a planar dipole antenna.

7. The antenna assembly of claim 1, wherein the planar antenna is a planar bowtie dipole antenna.

8. The antenna assembly of claim 1, wherein the planar antenna further comprises:

a radiating element;

a first end of two coplanar strips coupled to the radiating element;

a microstrip-to-coplanar balun coupled to a second end of the two coplanar strips; and a microstrip transmission line coupled to the microstrip-to-coplanar balun.

9. The antenna assembly of claim 1, wherein the first flexible substrate further comprises a balun ground plane fabricated on a second surface of the first flexible substrate, the balun ground plane positioned opposite the microstrip transmission line and the microstrip-to-coplanar balun.

10. The antenna assembly of claim 1, wherein the overlapping conductor ground plane is positioned opposite the radiating element and the coplanar strips.

11. Then antenna assembly of claim 1, wherein the frequency selective high impedance surface formed on the first surface of the second flexible substrate is positioned opposite the radiating element and the coplanar strips.

12. The antenna assembly of claim 1, wherein the frequency selective high impedance surface formed on the first surface of the second flexible substrate comprises a periodic array of voltage controlled varactor elements.

13. The antenna assembly of claim 1, wherein the frequency selective high impedance surface formed on the first surface of the second flexible substrate comprises a plurality of interdigital barium strontium titanate (BST) varactor-tuned unit cells.

14. The antenna assembly of claim 1, wherein each of the plurality of overlapping conductive plates of the overlapping conductor ground plane comprises a liquid crystal polymer (LCP) substrate having a continuous metal layer on a first side of the LCP substrate and a partially removed metal layer on a second side of the LCP substrate to expose a portion of LCP substrate, wherein the exposed portion of the LCP substrate of each of the plurality of overlapping conductive plates is the first portion of each of the plurality of overlapping conductive plates that is bonded to the second surface of the second flexible dielectric substrate.

15. An antenna assembly comprising:

a first flexible substrate comprising a planar dipole radiating element and a microstrip-to-coplanar strip balun positioned on a first surface of the first flexible substrate and a balun ground plane positioned on a second surface of the first flexible substrate, the balun ground plane positioned opposite the balun;

a first flexible dielectric substrate having a first surface bonded to a second surface of the first flexible substrate and positioned opposite the planar dipole radiating element;

a second flexible substrate comprising a frequency selective high impedance surface formed on a first surface of the second flexible substrate and, the first surface of the second flexible substrate bonded to a second surface of the first flexible dielectric substrate and positioned opposite the planar dipole radiating element;

a second flexible dielectric substrate having a first surface bonded to a second surface of the second flexible substrate and positioned opposite the planar dipole radiating element; and an overlapping conductor ground plane positioned opposite the planar dipole radiating element, the overlapping conductor ground plane comprising a plurality of overlapping conductive plates and each of the plurality of overlapping conductive plates comprising a first portion bonded to the second surface of the second flexible dielectric substrate and a second portion not bonded to the second surface of the second flexible dielectric substrate, wherein the second portion of each of the plurality of overlapping conductive plates is positioned to overlap another of the plurality of conductive plates having a first portion bonded to the second surface of the second flexible dielectric substrate to form the overlapping conductor ground plane.

16. The antenna assembly of claim 15, further comprising two coplanar strips coupled between the planar dipole radiating element and the microstrip-to-coplanar strip balun and a microstrip transmission line coupled to the microstrip-to-coplanar balun.

17. The antenna assembly of claim 15, wherein the first flexible dielectric substrate and the second flexible dielectric substrate comprise polydimethylsiloxane (PDMS).

18. The antenna assembly of claim 15, wherein the first flexible substrate and the second flexible substrate are liquid crystal polymer (LCP) substrates.

19. A method of manufacturing an antenna assembly, the method comprising:

fabricating a planar dipole radiating element and a microstrip-to-coplanar strip balun positioned on a first surface of a first flexible substrate and fabricating a balun ground plane on a second surface of the first flexible substrate, wherein the balun ground plane is positioned opposite the balun;

bonding a first surface of a first flexible dielectric substrate to a second surface of the first flexible substrate, wherein the first flexible dielectric substrate is positioned opposite the planar dipole radiating element;

fabricating a frequency selective high impedance surface formed on a first surface of a second flexible substrate;

bonding the first surface of the second flexible substrate to a second surface of the first flexible dielectric substrate, wherein the second flexible substrate is positioned opposite the planar dipole radiating element;

bonding a first surface of a second flexible dielectric substrate to a second surface of the second flexible substrate, wherein the second flexible dielectric substrate is positioned opposite the planar dipole radiating element; and bonding a first portion of each of a plurality of overlapping conductive plates to a second surface of the second flexible dielectric substrate and positioning a second portion of each of the plurality of overlapping conductive plates to overlap another of the plurality of conductive plates having a first portion bonded to the second surface of the second flexible dielectric substrate to form an overlapping conductor ground plane, wherein the second portion of each of the plurality of overlapping conductive plates is not bonded to the second surface of the second flexible dielectric substrate and wherein the overlapping conductor ground plane is positioned opposite the planar dipole radiating element.

20. The method of claim 19, further comprising fabricating two coplanar strips coupled between the planar dipole radiating element and the microstrip-to-coplanar strip balun and a microstrip transmission line coupled to the microstrip-to-coplanar balun on the first surface of the first flexible substrate.

* * * * *